US005374983A

United States Patent [19]

Isogai

[11] Patent Number: 5,374,983

[45] Date of Patent: Dec. 20, 1994

[54] FIXING DEVICE FOR FIXING A TONER IMAGE ON DIVERSE TYPES OF RECORDING MATERIAL

[75] Inventor: Mitsuru Isogai, Aichi, Japan

[73] Assignee: Minolta Camera Kabushiki Kaisha, Osaka, Japan

[21] Appl. No.: 116,492

[22] Filed: Sep. 3, 1993

Related U.S. Application Data

[63] Continuation of Ser. No. 931,729, Aug. 18, 1992, abandoned.

[30] Foreign Application Priority Data

Aug. 21, 1991 [JP] Japan ..... 3-209328
Aug. 21, 1991 [JP] Japan ..... 3-209329

[51] Int. Cl.[5] ..... G03G 15/20

[52] U.S. Cl. ..... 355/284; 219/216; 118/60

[58] Field of Search ..... 355/282, 284; 219/216, 219/388; 432/60; 118/60, DIG. 1

[56] References Cited

U.S. PATENT DOCUMENTS 4,045,165 8/1977 Nakajima et al. ..... 432/60
4,429,990 2/1984 Tamary ..... 432/60 X
4,549,803 10/1985 Ohno et al. ..... 219/388 X
4,593,992 6/1986 Yoshinaga et al. ..... 219/216 X
4,920,382 4/1990 Mills et al. ..... 355/284
4,942,433 7/1990 Stuart ..... 355/284
5,132,739 7/1992 Maur et al. ..... 355/284
5,160,970 11/1992 Isogai ..... 355/284
5,285,295 8/1981 Iwao et al. ..... 118/60

OTHER PUBLICATIONS

Technical Disclosure No. 90-10943, vol. 15-36 of JIII Journal of Technical Disclosure dated Jun. 20, 1990.

*Primary Examiner*—R. L. Moses
*Attorney, Agent, or Firm*—Willian Brinks Hofer Gilson & Lione

[57] ABSTRACT

Control circuit is arranged to move a mold releasing agent coating roller in contact with end toward and away from a fixing roller in a timing a sheet passing through a pair of fixing rollers is detected whether it is a film or not. In the case when the sheet is a film, the mold releasing agent coating roller is brought in contact with the fixing roller in the timing the leading end of the mold releasing agent reaches a nip section of the fixing roller after the leading end of the sheet has run into the nip section, while it is moved away from the fixing roller when the rear end of the sheet leaves the fixing roller simultaneously with the timing the rear end of the mold releasing agent passes through the nip section.

9 Claims, 7 Drawing Sheets

FIXING DEVICE FOR FIXING A TONER IMAGE ON DIVERSE TYPES OF RECORDING MATERIAL

This application is a continuation of application Ser. No. 07/931,729, filed Aug. 18, 1992, now abandoned.

BACKGROUND OF THE INVENTION

1. Technical Field of the Invention

The present invention relates to a fixing device for fixing a toner image transferred on a recording material, and more particularly, to a fixing device which is provided with a pair of fixing rollers which rotate in pressing contact with each other and a mold releasing agent supply means for feeding a mold releasing agent to the fixing rollers.

2. Description of Related Art

In a conventional fixing device, it has heretofore been arranged to apply a mold releasing agent onto the surface of fixing rollers in order to prevent toner from being offset to the fixing rollers, and various proposals have been raised to regulate the amount of mold releasing agent to be applied.

For instance, U.S. Pat. No. 4,045,165 discloses a fixing device wherein a supply roller for feeding a mold releasing agent to a fixing roller is provided to be movable toward and away from the fixing roller to prevent excessive supply of the mold releasing agent. In the U.S. Pat. No. 4,285,295, there is disclosed a fixing device wherein a mold releasing agent supply roller is fixedly disposed relative to a fixing roller with the same purpose as mentioned above, and a mold releasing agent supply pad is provided to be movable toward and away from the supply roller.

In such fixing devices, however, when a toner image is fixed onto a transparent film made of resin (hereinafter called as OHP film) which is used as an original for overhead projectors, the mold releasing agent tends to be somewhat excessively remained on the surface of the fixing roller after the toner image is fixed onto the OHP film which causes to lower the quality of an image formed on the OHP film. Especially, when an image formed on the OHP film is reproduced by a light transmissible colored toner, the reproducibility of the image is remarkably lowered. Further, it was also found by the inventor of the present invention that the OHP sheet often slipped by the mold releasing agent coated on the surface of the fixing rollers and is not properly taken into nip section of the fixing rollers.

In the device disclosed in the above-mentioned U.S. Pat. No. 4,285,295, there is a problem that foreign substance such as toner and paper dust particles sometimes adhere to the portion of the supply pad where it is brought in contact with the supply roller, and the particles collected in the portion of the supply pad prevents the mold releasing agent from being uniformly supplied on the surface of the supply roller and therefore causing continuous lines on the surface of the supply roller in the direction of circumference thereof by scraping off some of the mold releasing agent.

SUMMARY OF THE INVENTION

A primary object of the present invention is to provide a device which is capable of performing satisfactory fixing operations irrespective of any kind of sheet.

Another object of the present invention is to provide a device which is capable of performing fixing operations by surely taking a sheet into nip section of pair of fixing rollers even when a toner image is fixed on a resin sheet such as OHP sheet.

A further object of the present invention is to provide a device which is capable of uniformly coating a mold releasing agent on the surface of fixing rollers.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention will now be described referring to accompanying drawings.

Figure 1:
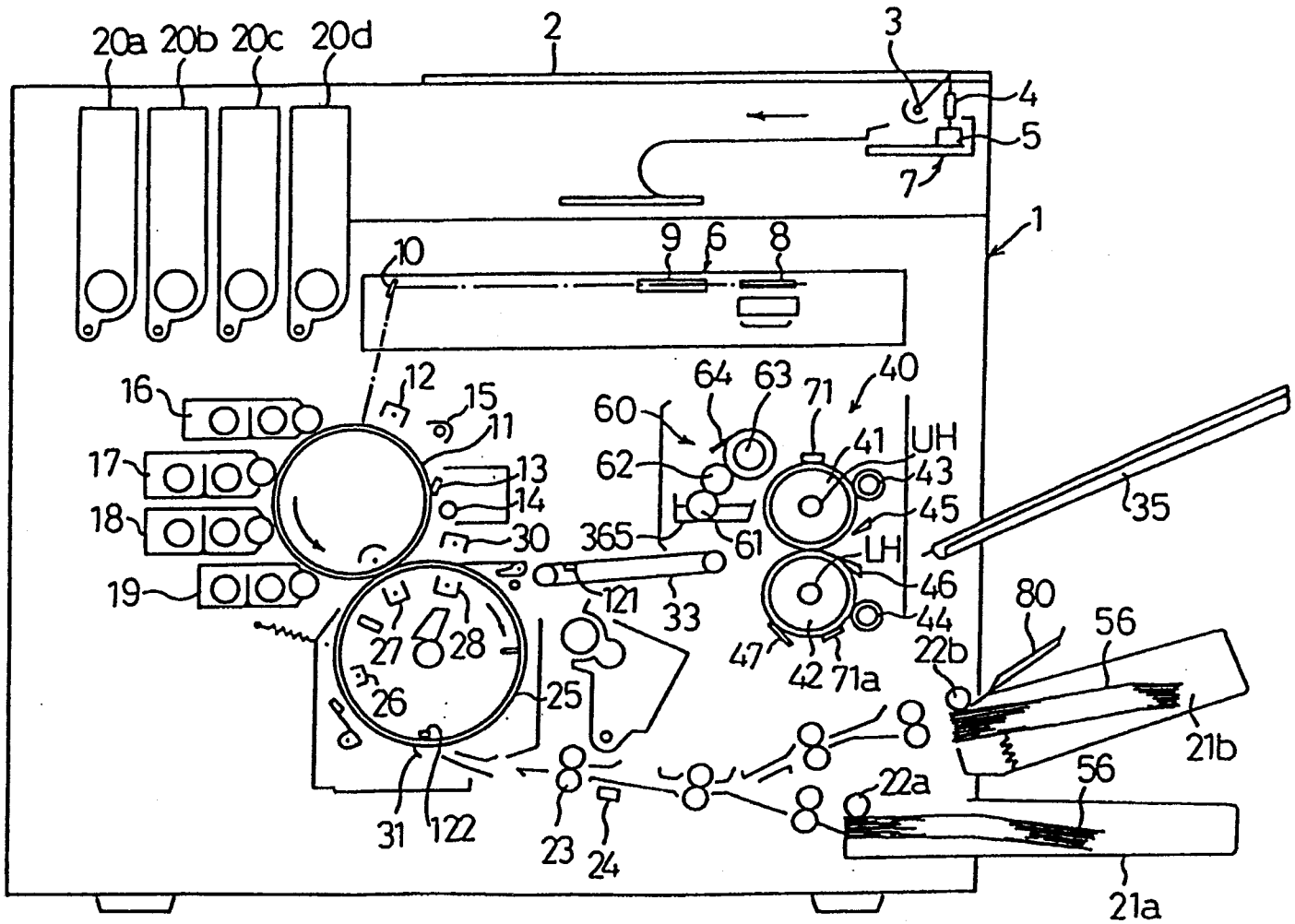
FIG. 1 is a schematic structural view showing a color copying machine which is provided with a fixing device to which the present invention is applied.

FIG. 1 shows a color copying machine 1 provided with a fixing device to which the present invention is applied. An original placed on an original glass 2 is exposed to a CCD line sensor 5 by an exposure lamp 3 and lens array 4 to be read as color signals. The color signals are converted into signals of Y (yellow), M (magenta), and C (cyan) or with an addition of K (black) by image processing circuit.

The copying machine 1 in the present embodiment is not provided with image memory for three colors, and an image reader unit 7 repeats scanning operations every time each colored image is formed based on which signals of Y, M, C or Y, M, C, K are subsequently transmitted to a laser optical system 6.

The laser optical system 6 is provided with a polygon mirror 8, an $f\theta$ lens 9 and a reflective mirror 10, and irradiates a modulated laser light based on said each color signal of Y, M, C or Y, M, C, K toward a photoconductive drum 11 for exposure.

Around the photoconductive drum 11, there are provided a drum cleaner 13, a toner collecting roller 14, an eraser lamp 15 and a charger 12 with four kinds of developing units. The photoconductive drum 11 is negatively charged by the charger 12.

A first developing unit 16 is arranged to supply a light transmissible cyan toner, a second developing unit 17 magenta toner, a third developing unit 18 yellow toner and a fourth developing unit 19 black toner respectively, and all these light transmissible toners; are negatively charged.

An electrostatic latent image formed on the photoconductive drum 11 through image exposure by the laser optical system 6 is visualized by each of the developing units 16–19 in a so-called inversion developing method.

The toners are supplied to each developing unit 16–19 through toner transport pipe (not shown) from each toner hopper 20*a*–20*d* where each colored toner is accommodated corresponding to the developing units.

A recording material 56 such as plain paper and OHP film is either stacked in paper feed cassettes 21*a*, 21*b*, or set one sheet by one sheet in a manual inserting tray 80, and each sheet of the recording material is transported into the copying machine 1 by paper feed rollers 22*a*, 22*b*. When the leading end of a recording material 56 comes in contact with a register roller 23, the recording material 56 is temporarily stopped to measure the following operation timing and to correct skews at the same time. A paper sensor 24 is utilized for this purpose. An OHP film is made of resin and is transparent. Therefore the paper sensor 24 is provided with a movable piece which is acted by the leading end of the recording material 56 to detect a transparent OHP film.

In order to successively transfer each toner image of C, M, Y, K formed on the photoconductive drum 11 onto the recording material 56, a transfer drum 25 is provided in a transfer section and is rotatively driven in the direction of the arrow in FIG. 1. The transfer drum 25 is equipped with a chucking claw 31 at its outer periphery for holding the recording material 56. Inside the drum 25, there are provided a sucking charger 26, a transfer charger 27 and a separation charger 28. Outside the drum 25, a separation charger 30 is disposed opposite to the separation charger 28.

The recording material 56 transported from the register roller 23 is held by the chucking claw 31 provided on the transfer drum 25, and is electrostatically wound around the transfer drum by the sucking charger 26 with rotation of the transfer drum 25. A visualized toner image formed on the photoconductive drum 11 is then transferred onto the recording material 56 when the recording material passes through the location between the transfer charger 27 and the photoconductive drum 11.

Adjacent to the chucking claw 31, there is provided an optical sensor 122 for confirming a wound recording material whether it is a plain paper or an OHP film. The sensor 122 comprises a light emitting element and a light receiving element. When a light which is emitted from the light emitting element and reflected by a recording material is detected by the light receiving element, it is judged that the material is a plain paper.

In the case when a colored image is reproduced, transfer process is repeatedly performed for three or four times successively onto a recording material 56 by the transfer drum 25. The charge on the recording material 56 which has completed the transfer process is removed by the separation chargers 28, 30, and is separated from the transfer drum 25 by the separation claw 32 to be further transported to a fixing device 40 by a transfer belt 33.

The fixing device 40 comprises an upper fixing roller 41, a lower fixing roller 42, cleaning rollers 43, 44, an oil coating unit 60, separating claws 45, 46, an oil collecting blade 47 and the like. A toner image transferred and formed on the recording material 56 is heated and pressed by the upper and lower fixing rollers 41, 42 to be fixed onto the recording material 56 which is thereafter discharged onto a paper discharge tray 35. Both the upper fixing roller 41 and the lower fixing roller 42 incorporate heaters UH and LH respectively for heat fusing operations. The surface of the lower fixing roller 42 is provided with a layer of elastic body, and the surface of the upper fixing roller 41 is made substantially as smooth as mirror plane. Reference numerals 71 and 71a represent thermistors which are brought in contact with the upper fixing roller 41 and the lower fixing roller 42 respectively, and they detect temperatures of the rollers 41 and 42.

Figure 2:
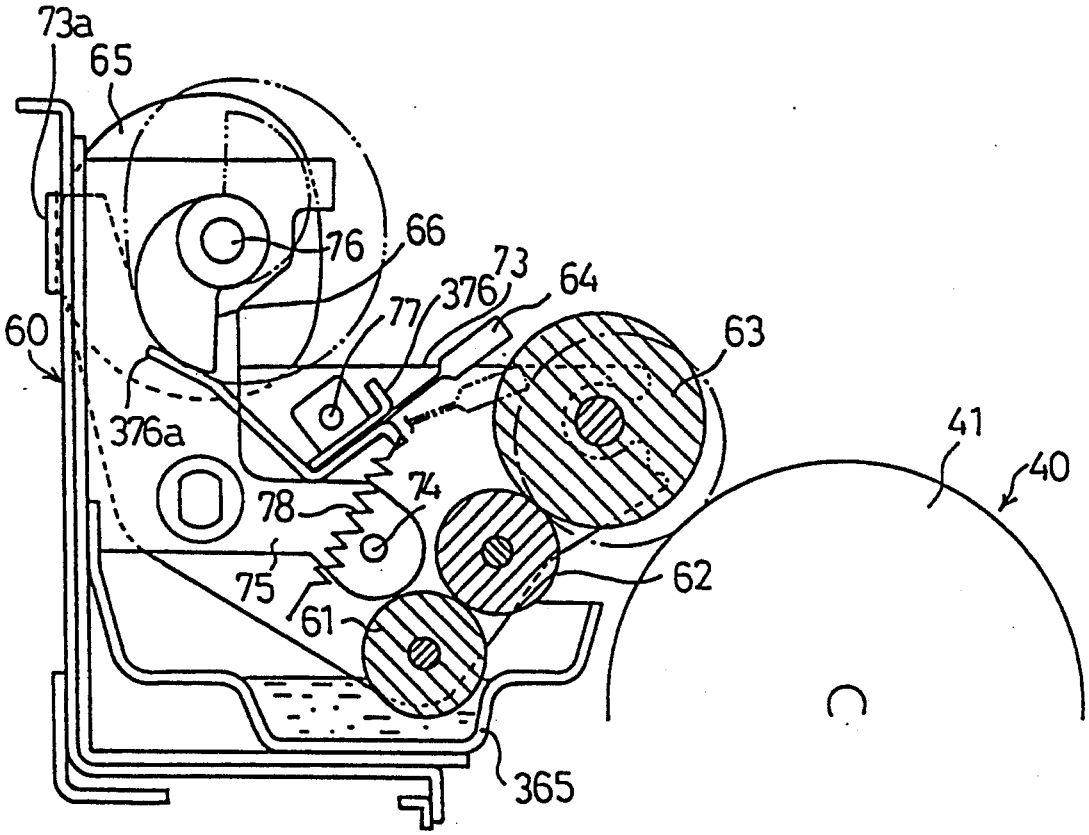
FIG. 2 is a transverse sectional view showing an oil coating mechanism of the fixing device.
Figure 3:
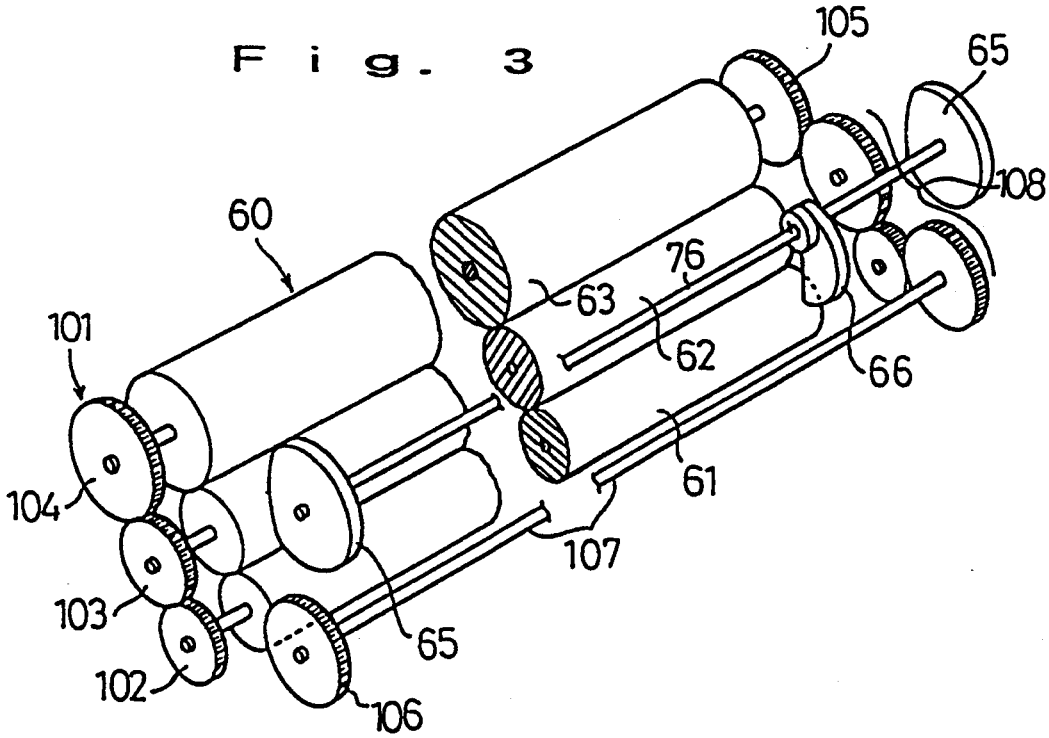
FIG. 3 is a perspective view showing a driving force transmission system of the oil coating mechanism.

As illustrated in FIGS. 2 and 3, an oil coating unit 60 is provided for supplying a mold releasing agent to the surface of the upper fixing roller 41, and it comprises oil feeding rollers 61, 62, an oil coating roller 63 and an oil regulating blade 64 and the like. A silicone oil stored in an oil tank 365 (FIGS. 1 and 2) to be used as a mold releasing agent is scooped up onto the oil coating roller 63 by the oil feeding rollers 61, 62, and is uniformly leveled by the oil regulating blade 64 to be an adequate amount for coating.

The oil coating roller 63 is controlled to be pressed on and separated from the upper fixing roller 41 by a press control cam 65 which is driven with a timing a recording material 56 is transported to the fixing device 40 and an initial timing the fixing roller starts rotation when the power is turned on. Oil feeding to the upper fixing roller 41 and suspension of the oil feeding are thus controlled which will be described later more in detail.

The movement of the oil regulating blade 64 toward and away from the oil coating roller 63 is also controlled by a press control cam 66 in order to prevent adhesion of foreign substances to the oil regulating blade 64.

The oil coating roller 63 is supported by a swing frame 73 together with oil feeding rollers 61 and 62 which are provided for feeding oil to the oil coating roller 63, and the swing frame 73 is pivotally supported by a fixed bracket 75 by a shaft 74. The fixed bracket 75 supports a rotative shaft 76 of said press control cams 65 and 66.

The oil regulating blade 64 is pivotally supported by the swing frame 73 with a shaft 77 at its base frame portion 376. The swing frame 73 and the base frame 376 are energized clockwise in FIG. 2 by a spring 78 which is activated between the frames, and each passive piece 73*a* and 76*a* is pressed in contact with the press control cams 65 and 66. The swing frame 73 and the base frame 376 are driven by the passive pieces 73*a* and 76*a*. The cam 65 thus moves the oil coating roller 63 toward and away from the upper fixing roller 41. While, the oil regulating blade 64 is also moved toward and away from the upper fixing roller 41 by the cam 65.

Figure 4:
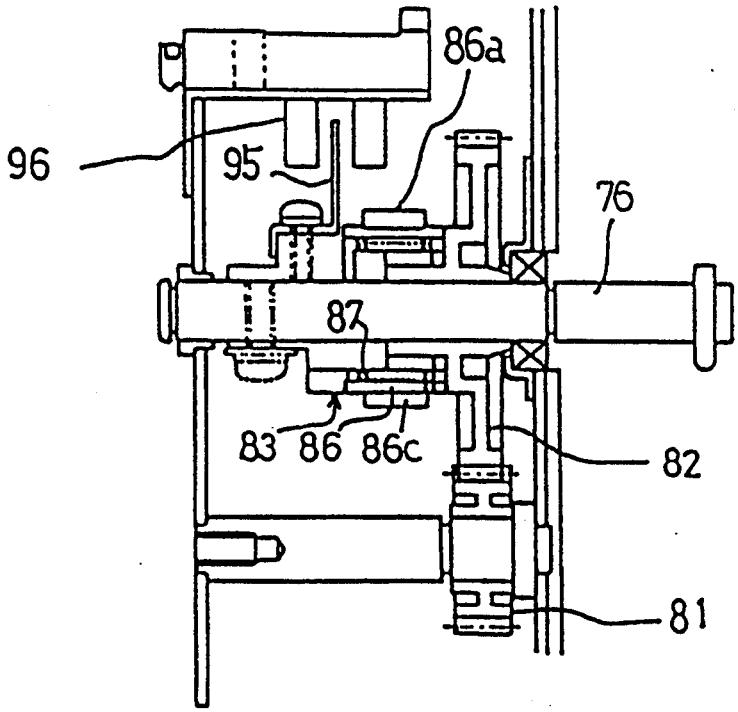
FIG. 4 is a sectional view showing driving force connecting and disconnecting mechanisms of the oil coating mechanism.
Figure 5:
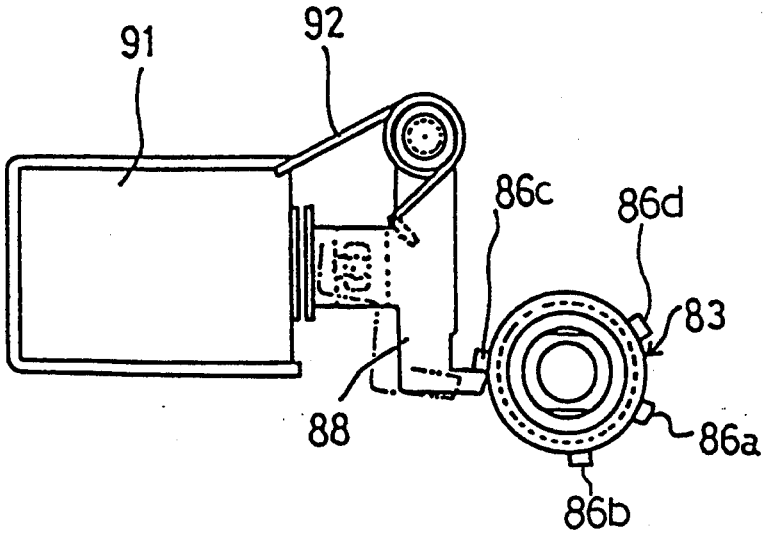
FIG. 5 is a side view showing mechanisms of connecting and disconnecting operations of the driving force connecting and disconnecting mechanisms.

The shapes and mutual positional relation of the cams 65 and 66 are arranged in a manner that after the oil regulating blade 64 is pressed in contact with the oil coating roller 63, the oil coating roller 63 is brought in contact with the upper fixing roller 41, and before the oil regulating blade 64 is moved away from the oil coating roller 63, the oil coating roller 63 is moved away from the upper fixing roller 41. The press control cams 65 and 66 arranged to act as described above are operated by a cam action control mechanism illustrated in FIGS. 4 and 5.

A driving force is transmitted from an unillustrated main motor to a spring clutch 83 through gears 81 and 82. The spring clutch 83 is of a normal closed type. In the clutch 83, an external cylinder 86 provided with claws 86a–86d at four locations on the outer periphery thereof is connected to one end of a spring 87. When the claws 86a–86d are engaged with a clutch control claw 88, the rotation of the gear 82 can not be transmitted to a rotative shaft 76, in other words, it is under an off state.

When a solenoid 91 is turned on and a clutch control claw 88 is rotatively driven against a spring 92, and the engagement with the claws 86a–86d is released, the spring 87 is immediately wound tightly to become an on state for transmitting the rotation of the gear 82 to a cam rotative shaft 76. Since the solenoid 91 is turned off immediately thereafter, the clutch control claw 88 is immediately returned to the position of engagement with the claws 86a–86d by the spring 92.

Accordingly, the cams 65 and 66 start rotation when the clutch control claw 88 is disengaged from the claws 86a–86d, and by causing the engagement again, the cams 65 and 66 are stopped at predetermined angles. The claw 86a is arranged at a position where the oil coating roller 63 is brought in contact with the upper fixing roller 41 and the oil regulating blade 64 is stopped under a pressing contact with the oil coating roller 63, while the claw 86c is arranged at a position where the oil coating roller 63 is moved away from the upper fixing roller 41 and the oil regulating blade 64 is stopped under a state that it is moved away from the oil coating roller 63. The claws 86b and 86d are arranged at positions where the oil coating roller 63 is moved away from the upper fixing roller 41 and the oil regulating blade 64 is slightly in contact with the circumferential surface of the oil coating roller 63, preferably at a position where the claws 86b and 86d are stopped when they come in contact with a mold releasing agent layer formed on the circumferential surface and do not practically contact with the circumferential surface of the roller 63.

According to the fixing device in the present embodiment, a speed of rotation of the fixing roller and the corresponding fixing speed, and a speed of rotation of the photoconductive drum and the corresponding system speed can be arranged differently. More particularly, in a color image forming operation, a fixing speed is set at ½ of a system speed for sufficient composition of different colored toners. When toners are fixed onto an OHP film, a fixing speed is set at ¼ of a system speed in order to form an image with excellent light transmissibility.

Figure 6:
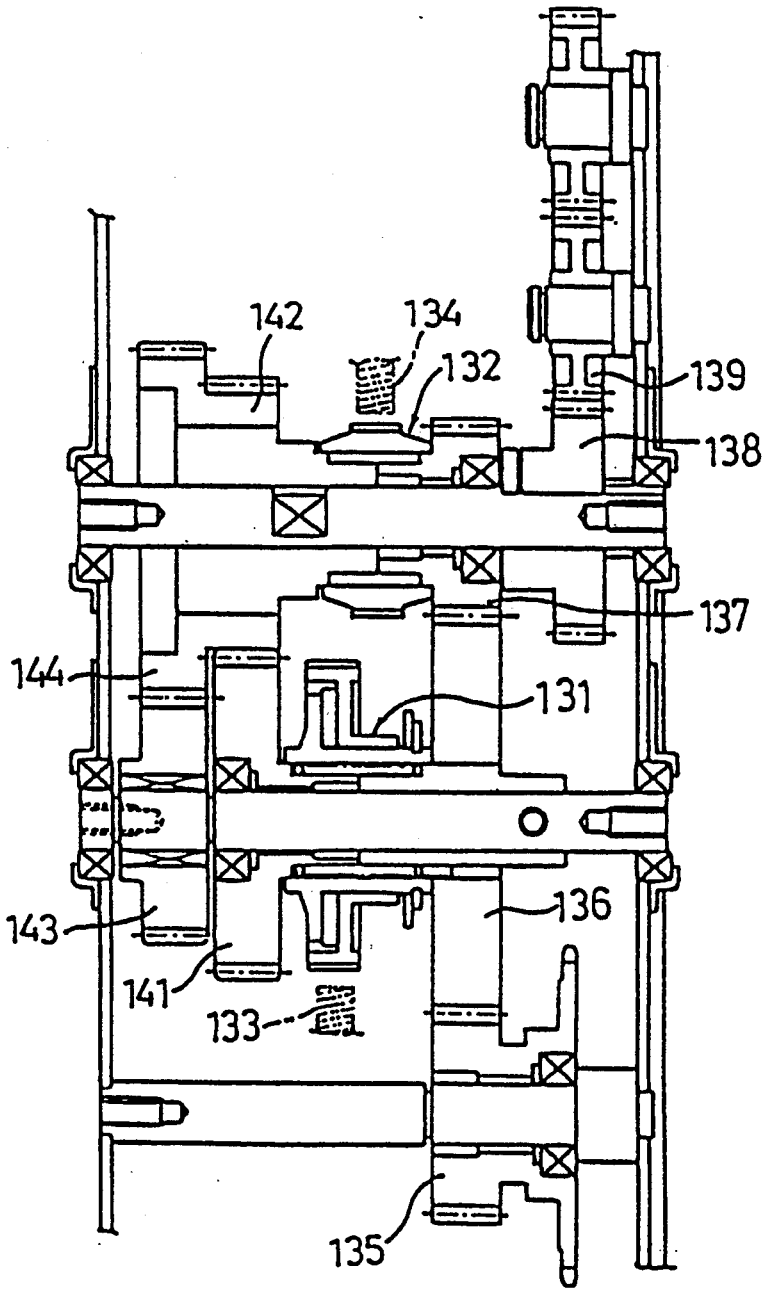
FIG. 6 is a sectional view showing a speed changeover mechanism of the fixing device.

At a warm-up time immediately after the power is applied, and when a single colored image is formed, a fixing speed is set at the same speed as system speed in order to avoid a delay in action. The change of a fixing speed is performed by changing the speed of the fixing device 40 and the speed of the transport belt 33 which supplies recording materials 56. As shown in FIG. 6, a transmission for changing a speed is provided with two spring clutches 131 and 132, and clutch control claws 133 and 134 for controlling the clutches. The clutch control claws 133 and 134 are operated by an unillustrated solenoid. The spring clutch 131 is of a normal open type, and the spring clutch 132 is of a normal closed type.

When the spring clutches 131 and 132 are under the normal condition, the driving force from a main motor is transmitted to gears 138 and 139 from a gear 135 through gears 136 and 137 to be applied to the fixing device 40 and the transport belt 33. A fixing speed at this time is the same as a system speed.

In case when a recording material 56 is a plain paper, the clutch control claws 133 and 134 are engaged with the spring clutches 131 and 132, and the spring clutch 131 is made under a closed state and the spring clutch 132 an open state respectively. Under such conditions, the driving force from the main motor is transmitted to gears 138 and 139 from the gear 135 through gears 136, 141 and 142 to be applied to the fixing device 40 and the transport belt 33. A fixing speed at this time is ½ of a system speed.

In case if a fixing speed is different from a system speed, a recording material 56 needs to be transported at a fixing speed after it has passed through a transfer location where a toner image is transferred onto the recording material 56. Accordingly, the distance from the transfer location to the fixing device has to be longer than the maximum length of recording materials 56.

On the other hand, in order to manufacture a copying machine smaller in size, it is necessary that the change of a fixing speed has to be performed when the leading end of a recording material 56 has reached the position of the fixing device as near as possible. However, due to mechanical or electrical factors on the part of a transmission, it is inevitable that a fixing speed is not stabilized when it is changed.

Instability in a fixing speed does not affect the transport of a plain paper, however, it affects much the transport of an OHP film. In other words, a fixing roller which is rotated under an unstabilized speed obstructs the OHP film to run thereinto. This phenomenon is remarkably noticed especially in a fixing device which is arranged to perform oil coating operations.

In the present embodiment, it is arranged that the speeds of the transport belt 33 and the fixing rollers 41, 42 are changed corresponding to a predetermined fixing speed when a recording material 56 is transported to the fixing device 40. The change of speed is timely controlled based on a signal from a sensor 121 (FIG. 1) provided adjacent to the transport belt 33. The time for changing a fixing speed for an OHP film is set earlier than that for a plain paper.

Figure 8:
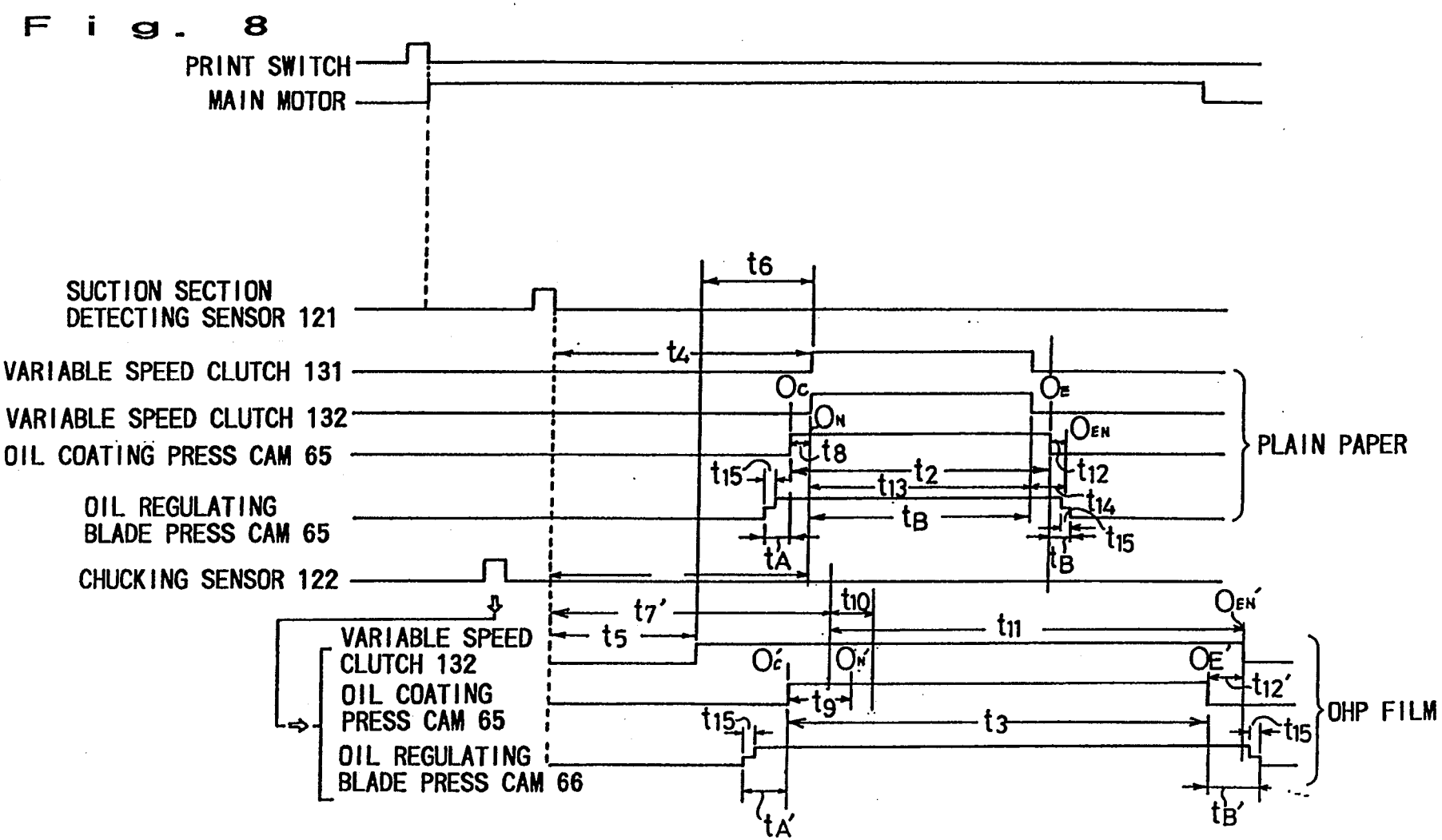
FIG. 8 is a time chart showing actions of the fixing device related to the present invention.

More particularly, as illustrated in FIG. 8, in case of a plain paper, the clutches 131 and 132 are operated after a predetermined time $t_4$ upon a signal is emitted from the sensor 121, and a system speed is changed to a fixing speed. The system speed changed to a fixing speed is returned to the original system speed again after the lapse of time required for a recording material 56 to pass through the fixing device.

In case of OHP film, it is first detected by a sensor 122 provided with the transfer drum 25 that a recording material 56 is a transparent OHP film. Based on the detection, only the clutch 132 is operated after a predetermined time $t_5$ upon a signal is emitted from the sensor 121, and a system speed is changed to a fixing speed. The system speed changed to a fixing speed is returned to the original system speed again after the laps of time required for a recording material 56 to pass through the fixing device.

Since the time $t_5$ is shorter than time $t_4$, the time to change a fixing speed in the case of OHP film is earlier than in the case of plain paper. The time difference $t_6$ between time $t_4$ and time $t_5$ is sufficient for a fixing speed to become a stabilized low speed which is approximately 1.5 seconds.

Figure 7:
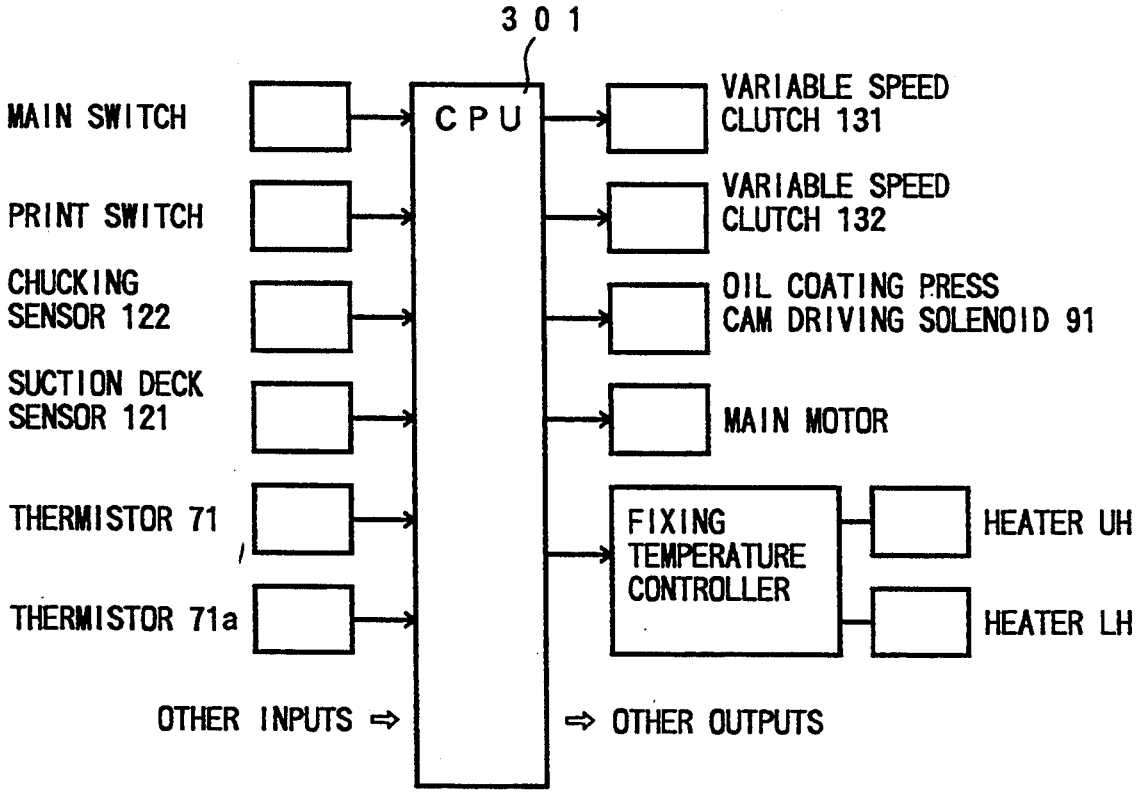
FIG. 7 is a block diagram showing a control circuit.

FIG. 7 is a block diagram showing a control circuit for controlling a variety of structural elements described above. CPU 301 is connected with each one of the above-mentioned input and output elements, and said fixing device is controlled according to a time chart shown in FIG. 8.

Description will now be made on the timing for feeding oil and stopping oil supply to the fixing roller referring to FIG. 8.

An oil coating operation which is performed when a toner image is fixed onto a recording material 56 effectively prevents the toner on a recording material 56 from being offset to the upper fixing roller 41.

As illustrated in FIG. 8, when a print switch is turned on, a main motor is rotated to start a copying operation. Then, a timing to start oil application onto the upper fixing roller 41 by the oil coating roller 63 and a timing to stop the oil application are changed corresponding to a timing when a recording material 56 passes through nip section of the upper fixing roller 41 and lower fixing roller 42 depending on whether a recording material 56 reaching the nip section is plain paper or OHP film. A recording material 56 is detected as to whether it is a plain paper or an OHP film by the optical sensor 122 provided with the transfer drum 25 as described above.

An oil coating time $t_3$ required for an OHP film is remarkably longer compared with an oil coating time $t_2$ required for a plain paper as shown in FIG. 8. This is because the speed of the fixing rollers 41 and 42 are changed as described above.

There are also differences to some extent by the change of an oil application start timing and a timing to stop the oil application depending on whether a recording material 56 is a plain paper or an OPH film.

In the case when a recording material 56 is plain paper, after the lapse of time $t_7$ upon it is detected by the sensor 121, it reaches the nip section of the fixing rollers 41 and 42. While, in the case when a recording material 56 is OHP film, after the lapse of time $t_7$, upon it is detected by the sensor 121, it reaches the nip section of the fixing rollers 41 and 42.

When a recording material 56 is plain paper, an oil application start timing onto the upper fixing roller 41 by the oil coating roller 63 is set so as to coincide with the timing the leading end of an oil coated at a time point of $O_c$ in FIG. 8 reaches the nip section at the time point $O_N$ in which time $t_8$ is elapsed when the recording material 56 reaches the nip section. Consequently, wasteful consumption of oil can be avoided since oil is not fed to the nip section before the recording material 56 reaches thereto, and a trouble of offset can be solved since the oil supply to the nip section is not delayed when the recording material 56 is transported thereto.

When a recording material is OHP film, the leading end of an oil coated on the upper fixing roller 41 at a time point $O_c$, reaches the nip section at a time point $O_{N'}$, time $t_9$ after the time point $O_{c'}$. The reason why $t_9 > t_8$ is that a fixing speed for an OHP film is lower than that for a plain paper.

An oil application start timing onto the upper fixing roller 41 is set so as to make the time point $O_N$, as one time point in the time $t_{10}$ wherein non-image-formed portion in the leading end of an OHP film passes through the nip section, in other words, during the time from the time point the leading end of an OHP film runs into the nip section to the time point the rear end of non-image-formed portion passes through the nip section. Consequently, when an OHP film which is a recording material 56 runs into the nip section, oil is not collected in the nip section, and no slip of the recording material is occurred by excessive oil between the fixing rollers 41 and 42 thereby the material is able to stably run into the nip section.

At the time when an image-formed portion of an OHP film of a recording material 56 reaches the nip section, an oil has already reached the nip section so that offset to the fixing rollers 41 and 42 is surely prevented.

Aforementioned oil coating time $t_2$ and $t_3$ are also changed by the size of a recording material 56 since it is necessary to continuously supply oil to the nip section until the rear end of the recording material 56 passes through the nip section for prevention of offset.

The rear end of an OHP film of recording material 56 passes through the nip section $t_{11}$ time after the leading end of the OHP film has run into the nip section. While, the rear end of an oil reaches the nip section at a time point $O_{EN'}$, $t_{12}$ time from a time $O'_E$ when an oil coating application on the upper fixing roller 41 is stopped. A timing $O_E$, to stop an oil coating application is then set so as to coincide with the time when the recording material 56 passes through the nip section. Accordingly, excessive supply of oil to the upper fixing roller 41 is prevented after the OHP film of recording material 56 has passed through the nip section whereby wasteful consumption of oil and lowering of a permeable color reproducibility of a permeable toner image by an excessive supply of oil can be prevented.

On the other hand, in the case when the recording material 56 is a plain paper, the rear end of the recording material 56 passes through the nip section when a time $t_{13}$ has elapsed after the leading end of the recording material run into the nip section. In the meantime, the rear end of an oil reaches the nip section at a time point OEN which is $t_{12}$ time after a time point OE when oil coating application onto the upper fixing roller 41 has stopped. A timing OE which is a time point to stop oil coating application is set to have the rear end of the oil reach the nip section $t_{14}$ time after the rear end of the recording material 56 has reached the nip section.

Accordingly, even if a fixing operation is performed onto a recording material 56 which absorbs oil easily like a plain paper, deterioration of the surface of the fixing rollers caused by the friction with thermisters 71 and 72, damage and occurrence of abnormal sound which arise from insufficient supply of oil can be avoided since sufficient amount of oil is remained on the fixing rollers 41 and 42. More particularly, a quantity of application is controlled by adjusting a timing for starting application and a timing for finishing the application with a fixed quantity of application per unit hour.

Pressing control for the oil regulating blade 64 relative to the oil coating roller 63 and for the oil coating roller 63 relative to the upper fixing roller 41 are performed as shown in FIG. 8.

For instance, the oil regulating blade 64 is brought in contact with the oil coating roller 63 after a predetermined time upon a recording material 56 is detected by the sensor 121 provided at a suction section. The oil coating roller 63 is raced for a predetermined time $t_A$ under the condition stated above. At this stage, foreign substances such as paper dust particles stuck to the surface of the oil coating roller 63 are collected together with excessive oil on the oil coating roller 63 by the oil regulating blade 64 at the position where the oil regulating blade 64 is in contact with the oil coating roller 63, and the collected foreign substances are covered by the oil collected thereat.

After the oil coating roller 63 is raced, the oil coating roller 63 is brought in contact with the upper fixing roller 41, and oil application is conducted by the oil coating roller 63 which has been cleaned after oil is regulated. Upon completion of an oil coating operation, the oil coating roller 63 is moved away from the upper fixing roller 41, and then, the oil coating roller 63 is raced for a predetermined time $t_B$ under a state that the oil regulating blade 64 is in contact with the oil coating roller 63. Foreign substances such as paper dust particles stuck to the surface of the oil coating roller 63 is thus removed by the racing.

Thereafter, the oil regulating blade 64 is moved away from the oil coating roller 63. At this stage, foreign substances and the oil which covers the foreign substances are collected together at a location on the oil coating roller 63. The oil and foreign substances collected are released from the oil regulating blade 64, and with the rotation of the oil coating roller 63, they are carried into an oil storage layer 365 through oil supply rollers 61 and 62.

Foreign substances stuck to the edge of the oil regulating blade 64 is flowed into said oil storage layer 365 together with the oil collected when the oil regulating blade 64 is moved away from the oil coating roller 63. Foreign substances remained on the oil coating roller 63 and stuck to the edge of the oil regulating blade 64 are finally removed by interposition of the oil. Predetermined time $t_A$ and $t_B$ are the time, for instance, the oil coating roller 63 is rotated for one to several times.

In the present embodiment, it is arranged that for a predetermined time $t_{15}$ between an initial time when the oil regulating blade 64 is brought in contact with the oil coating roller 63 and an initial time when the oil regulating blade 64 is moved away from the oil coating roller 63, a semi-contact condition is controlled. In the semi-contact condition, the edge of the oil regulating blade 64 comes in contact with the surface of an oil coated on the oil coating roller 63, however, it does not completely contact with the surface of the oil coating roller 63 and causes a gap and a weak contact portion therebetween.

In the case when the semi-contact condition is controlled when the oil regulating blade 64 is brought in contact with the oil coating roller 63, foreign substances stuck to the edge of the oil regulating blade 64 is carried away through a gap and a weak contact portion formed under a semi-contact condition between the edge of the oil regulating blade 64 and the oil coating roller 63 since the foreign substances are in contact with the surface of the oil layer on the oil coating roller 63. The foreign substances carried away are returned to an oil supply side after they reached the oil supply portion by the oil supply roller 62 so that the oil regulation blade 64 is brought in contact with the oil coating roller 63 wherein foreign substances stuck to the edge of the oil regulating blade 64 is removed to constrain the affection of foreign substances to an oil coating condition.

When said semi-contact condition control is conducted at the time when the oil regulating blade 64 is brought in contact with and moved away from the oil coating roller 63, the oil regulating blade 64 which has been regulating the amount of oil held on the oil coating roller 63 under complete contact with the surface of the oil coating roller 63 is likely to collect and stick foreign substances such as toner and paper dust particles on the edge thereof at the stage of oil coating application, however, since there forms a gap and a weak contact portion between the edge of the oil regulating blade 64 and the surface of the oil coating roller 63 under the semi-contact condition, foreign substances which might be stuck to the edge is carried away by the oil layer to return to the oil supply section of the oil coating roller 63 in the same manner as described above, and oil coating condition in an oil coating operation thereafter is not constrained.

According to the present invention, generation of irregularity of oil coated on the oil coating roller 63 caused by foreign substances stuck to the edge of the oil regulating blade 64 can be prevented thereby improving color reproducibility of a permeable image by permeable colored toner formed on a color image and OHP film.

Figure 9:
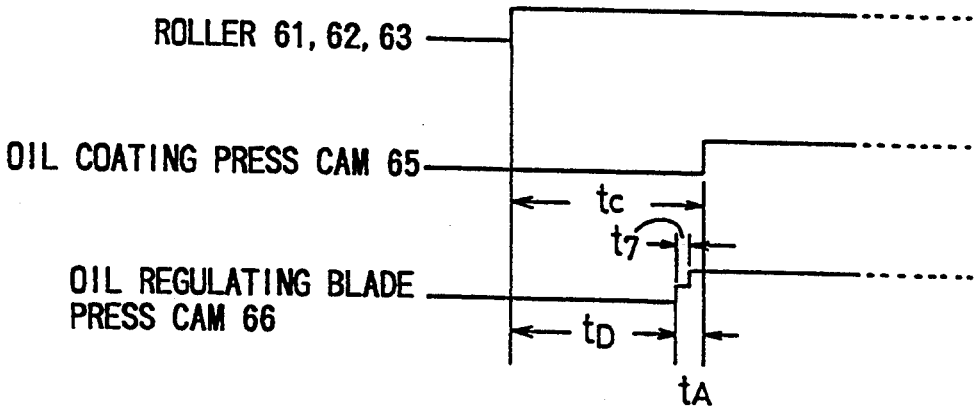
FIG. 9 is a time chart showing another example of an action of driving timing of oil supply roller and oil coating roller.

In the embodiment of the present invention, it is arranged to drive the oil supply rollers 61 and 62, and the oil coating roller 63 by a driving mechanism 101 when a main motor is driven. However, it may also be arranged to drive the oil supply rollers 61, 62, and the oil coating roller 63 only when they are required To be driven by providing the driving mechanism 101 with a clutch or the like. In this case, as shown in FIG. 9, the oil supply rollers 61, 62 and the oil coating roller 63 are started to rotate synchronously with the drive of the fixing rollers earlier by a predetermined timing $t_c$ than the time oil has to be applied. This is sufficient enough for the oil coating roller 63 to be in contact with the oil regulating blade 64 after a predetermined time $t_D$ has elapsed from the time the oil supply rollers 61, 62 and the oil coating roller 63 started to rotate. Thereafter, the oil coating roller 63 is raced for a time $t_A$ during which period of time the oil on the oil coating roller 63 is made sufficiently uniform. After the oil coating roller 63 is raced, the oil coating roller 63 is brought in contact with the upper fixing roller 41 to perform an oil coating operation.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for fixing a toner image on a sheet, comprising:

a pair of fixing rollers for fixing a toner image on a sheet passing through between both of the fixing rollers by giving heat;

coating means for coating a mold releasing agent at least on one of the fixing rollers;

changeover means for changing over the mold releasing agent coating means between on and off conditions:

judging means for judging whether a sheet is resin film or not; and control means for operating the changeover means to delay the mold releasing agent from reaching a nip section of the pair of fixing rollers until after a leading end of a sheet has reached the nip section when the sheet is judged as a resin film by the judging means, wherein the control means stops the coating operation so that the rear end of a mold releasing agent coated on the fixing roller passes through the nip section substantially at the same time the rear end of a sheet departs from the nip section of the pair of fixing rollers when the sheet is judged as a resin film by the judging means.

2. A fixing device for fixing a toner image on a sheet, comprising:

a pair of fixing rollers for fixing a toner image on a sheet passing through between both of the fixing rollers by giving heat;

coating means for coating a mold releasing agent at least on one of the fixing rollers;

changeover means for changing over the mold releasing agent coating means between on and off conditions;

judging means for judging whether a sheet is resin film or not; and control means for operating the changeover means to delay the mold releasing agent from reaching a nip section of the pair of fixing rollers until after a leading end of a sheet has reached the nip section when the sheet is judged as a resin film by the judging means, wherein the control means further operates the changeover means so as to cause the mold releasing agent to reach the nip section substantially at the same time the leading end of a sheet reaches the nip section of the pair of fixing rollers when the sheet is judged not a resin film by the judging means.

3. The fixing device as defined in claim 2, wherein the control means further acts to stop the changeover means so that the rear end of a mold releasing agent coated on the fixing roller passes through the nip section after the rear end of a sheet has left the nip section of the pair of fixing rollers when the sheet is judged not a resin film by the judging means.

4. A fixing device for fixing a toner image on a sheet, comprising:

a pair of fixing rollers for fixing a toner image on a sheet passing through between both of the fixing rollers by giving heat;

coating means for coating a mold releasing agent at least on one of the fixing rollers;

judging means for judging whether a sheet is a resin film or not; and changeover means for reducing an amount of the mold releasing agent applied to said at least one of the fixing rollers by the coating means when the sheet is judged as a resin film by the judging means.

5. The fixing device as defined in claim 4, wherein the coating means includes a coating member movable between an operating position where the coating means comes in contact with one of the fixing rollers and a non-operating position where the coating means moves away from the fixing roller, and a driving means for moving the coating member, said changeover means being arranged to change an amount of application of a mold releasing agent by controlling an operating time of the coating means.

6. A fixing device for fixing a toner image on a sheet, comprising:

a pair of fixing rollers for fixing a toner image on a sheet passing through between both of the fixing rollers by giving heat;

a coating roller for coating a mold releasing agent at least on one of the fixing rollers;

a contact member movably supported to operate in a first condition where it moves away from the coating roller, a second condition where it comes in weak contact with the coating roller and a third condition where it is pressed in contact with the coating roller;

first driving means for moving the contact member;

second driving means for moving the coating roller; and control means for driving the contact member so as to move the contact member from the first condition to the third condition or from the third condition to the first condition after the second condition has been maintained for a predetermined period of time when the second driving means is operated.

7. The fixing device as defined in claim 6, further comprising:

support means for movably supporting the coating roller between an operating position where it comes in contact with said one of the fixing rollers and a non-operating position where it is moved away from said one of the fixing rollers;

control means for operating the first driving means which is arranged to move the contact member before the second driving means is operated when the coating operating position, and also for operating the first driving means after the second driving means is operated when the coating roller is moved from an operating position to a non-operating position.

8. A fixing device for fixing a toner image on a sheet, comprising:

a pair of fixing rollers for fixing a toner image on a sheet passing through between both of the fixing rollers by giving heat;

a coating roller for coating a mold releasing agent at least on one of the fixing rollers;

a contact member movably supported to operate in a first condition where it moves away from the coating roller, a second condition where it comes in contact with the coating roller and a third condition where it is pressed in contact with the coating roller, wherein the contact member is a blade for regulating an amount of mold releasing agent supplied on the coating roller;

first driving means for moving the contact member;

second driving means for moving the coating roller; and control means for driving the contact member so as to move the contact member from the first condition to the third condition or from the third condition to the first condition after the second condition has been maintained for a predetermined period of time when the second driving means is operated.

9. An image forming apparatus, comprising:

image forming means for forming a toner image on a sheet;

a pair of rollers for fixing the toner image on the sheet;

coating means for coating a mold releasing agent at least on one of the rollers;

a first actuating means for actuating said coating means so that the leading end of a mold releasing agent coated on the roller passes through a nip section of the pair of rollers after the leading end of a sheet has reached the nip portion;

a second actuating means for actuating said coating means so that the leading end of a mold releasing agent coated on the roller passes through the nip section of the pair of rollers when the leading end of a sheet reaches the nip portion;

judging means for judging a type of sheet; and selecting means for selecting either said first actuating means or said second actuating means based on the result of the judging means.

* * * * *

UNITED STATES PATENT AND TRADEMARK OFFICE

CERTIFICATE OF CORRECTION

PATENT NO. : 5,374,983

DATED : December 20, 1994

INVENTOR(S) : Mitsuru Isogai

It is certified that error appears in the above-indentified patent and that said Letters Patent is hereby corrected as shown below:

On the cover page, in line 2 of the Abstract paragraph, change "end" to --and--.

In column 12, line 20 (Claim 7, line 11) after "coating" insert --roller is moved from a non-operating position to an--.

Signed and Sealed this

Ninth Day of May, 1995

Bruce Lehman

*Attest:*

BRUCE LEHMAN

*Attesting Officer*

*Commissioner of Patents and Trademarks*